United States Patent [19]

Nagayama

[11] 4,164,776

[45] Aug. 14, 1979

[54] ELECTRONIC COMBINATION CONTROLLED MEANS

[75] Inventor: Sigekazu Nagayama, Yokohama, Japan

[73] Assignee: Hisao Nakamura, Tokyo, Japan

[21] Appl. No.: 849,517

[22] Filed: Nov. 7, 1977

[30] Foreign Application Priority Data

Nov. 10, 1976 [JP] Japan ..... 51-134148
Dec. 28, 1976 [JP] Japan ..... 51-157408

[51] Int. Cl.[2] ..... E05B 49/00; H01H 47/00

[52] U.S. Cl. ..... 361/172; 70/278; 339/18 C; 340/147 MD

[58] Field of Search ..... 361/172, 171, 426; 340/147 R, 147 MD, 147 PC; 307/10 AT; 70/278, 279; 339/18 C, 18 R, 150 T, 198 R, 252 R, 253 R, 253 S, 265 F, 263 R

[56] References Cited

U.S. PATENT DOCUMENTS

| | | | |
|---|---|---|---|
| 2,677,814 | 5/1954 | Miller | 339/18 C X |
| 3,215,973 | 11/1965 | Falconer | 339/254 R X |
| 3,539,977 | 11/1970 | Woertz | 339/198 R |
| 3,731,156 | 5/1973 | Watson | 361/172 |
| 3,739,233 | 6/1973 | Edelson | 361/172 |
| 3,754,148 | 8/1973 | Nye | 361/172 X |
| 3,764,982 | 10/1973 | Kidnocker, Jr. | 340/147 MD X |
| 4,038,846 | 8/1977 | Klann | 361/172 X |

OTHER PUBLICATIONS

"Simple Electronic Combination Lock," by Joe A. Rolf; Popular Electronics, Nov. 1973; pp. 51–53.

*Primary Examiner*—Patrick R. Salce
*Attorney, Agent, or Firm*—Wenderoth, Lind & Ponack

[57] ABSTRACT

The present invention electronic locking device wherein a plurality of thyristors are connected in series, and key type switches whose number is equal to that of the thyristors are provided to self maintain and energize each of the thyristors. An optional set of key type switches is provided to release the self maintained and energized state of the thyristors. A resistor is provided to limit the electric power to be supplied to the gate of each thyristor. Thus a circuit which is capable of supplying a forward base bias to a transistor from the final stage of the thyristors only when the thyristors are sequentially self maintained and energized from the power source side is formed. The load, such as relays or solenoids, which is connected to the collector side of the transistor can be optionally operated by the supply of a forward bias base.

3 Claims, 4 Drawing Figures

ELECTRONIC COMBINATION CONTROLLED MEANS

BACKGROUND OF INVENTION

Heretofore, various electronic devices have been invented, and been put into practical use, but many of those conventional electronic locking devices one formed by a circuit for storing preset digits, a comparison circuit for comparing input pulses and stored digits, a coincidence circuit for detecting coincidence thereof, and an output circuit for generating an output when coincidence is obtained. Accordingly, since the conventional electronic locking device uses a large quantity of various electronic parts, it has been extremely difficult to make it into a compact size. Also, since the conventional electronic locking device needs a stable power source, the dry cell battery cannot be used from the standpoint of power consumption, and it has to be powered through a DC constant voltage power source from commercial electric power. Furthermore, since the conventional electronic locking devices are expensive because of their manufacturing cost, they can be used only in such special facilities as banks, jewelery shops, and the like and therefore they have not been widely used in ordinary households. The present invention relates to an electronic locking device which has eliminated the foregoing drawbacks of the conventional devices.

OBJECTS AND SUMMARY OF INVENTION

An object of the present invention is to provide an electronic locking device which consumes very little electric power when not operated, and which is excellent in the saving of electric power, and yet has small size and a low cost to enable use in ordinary households, and which is outstanding in locking effect. This object can be achieved by decreasing the number of electronic parts, and simplifying the circuits. The present invention can be achieved by connecting a plurality of thyristors in series to supply forward bias to the base of a transistor in the DC circuit, energizing and self maintaining the thyristors sequentially from the power source side, and supplying the forward bias from the thyristor of the final stage, thereby forming a circuit in which if more than two thyristors are unable to self maintain simultaneously, the supply of the forward bias cannot be made from the non-power source side.

DETAILED DESCRIPTION OF INVENTION

Figure 1:
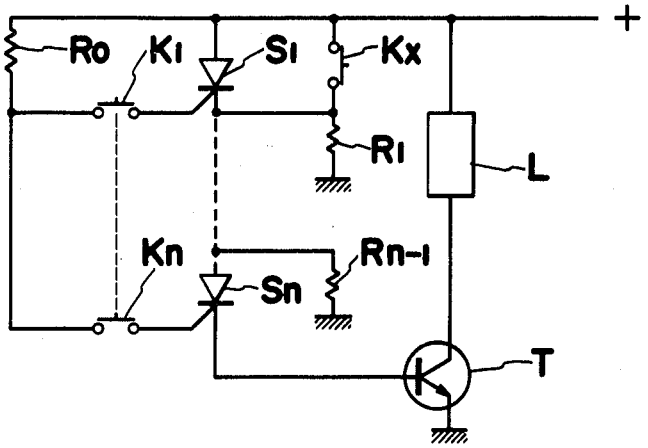
FIG. 1 is a circuit diagram showing a basic embodiment of the present invention.

In FIG. 1, I denotes a transistor, and $S_1 \ldots S_n$ denote n thyristors whose quantity is optional. $K_1 \ldots K_n$ denote n key type switches provided in correspondence to the thyristors $S_1 \ldots S_n$ to self maintain each of the thyristors $S_1 \ldots S_n$. $K_x$ denotes an open switch to shift the thyristor $S_1$ from the self maintained state, namely, from the energized stage to the nonenergized state. $R_0$ denotes a resistor for limiting the current to be supplied to the gate of each thyristor $S_1 \ldots S_n$, and being common to all the thyristor gates. Since the resistance value of $R_0$ is set so that a gate current slightly exceeding the minimum gate current of each thyristor gate can be supplied, if more than two of the switches $K_1 \ldots K_n$ are simultaneously pressed down for the purpose of self maintaining more than two of the thyristors, the gate current is in short supply, and the desired thyristors cannot be self maintained. $R_1 \ldots R_{n-1}$ are resistors for supplying self maintaining current to each thyristor $S_1 \ldots S_n$. L denotes the load, for example a relay or solenoid. By the way, a DC power source such as a dry cell battery is used as the power source. These elements are connected as shown in the drawing.

In order to energize the transistor T with this connection, sequential self maintaining of each thyristor $S_1 \ldots S_n$ from the power source side becomes necessary. For this purpose, the corresponding key switches ranging from $K_1$ to $K_n$ must be pressed sequentially from the power source side. In this manipulation, in correspondence to the pressing of each key switch $K_1 \ldots K_n$, each thyristor $S_1 \ldots S_n$ is sequentially self maintained from the power source side, and supply of the forward base bias to the transistor T from the thyristor $S_n$ of the final stage can be made possible. With the supply of the forward base bias, the transistor T is energized and the flow of the collector current becomes possible to operate the relay or solenoid used as the collector load L. In this stage, if a person follows the wrong order in pressing the key switches $K_1 \ldots K_n$, all thyristors $S_1 \ldots S_n$ cannot be self maintained, and the forward base bias cannot be supplied to the transistor T so that the load cannot be operated.

Furthermore, releasing of energization of the transistor assume is performed by merely cutting off the supply of the forward base bias. For this purpose, the thyristor $S_1$ may be put in non-self maintained state. Namely, when the open switch $K_x$ is turned ON, the connection between the anode and cathode of the thyristor $S_1$ is shortcircuited, and the thyristor $S_1$ is transformed from the self maintained state to the non-self maintained state, and as the result thereof, all the remaining thyristors assumes the non-self maintained state, and the collector current is not supplied by the transistor T.

Accordingly, if the key switches $K_1 \ldots K_n$ are arranged at random, and furthermore an optional number of digits corresponding to the open switch $K_x$ are arranged at random, it becomes extremely difficult for a person other than a person knowing the order of pressing the switches $K_1 \ldots K_n$, namely a person knowing the code digits, to energize the transistor T, whereby this electronic locking device can provide an efficient locking effect.

Figure 2:
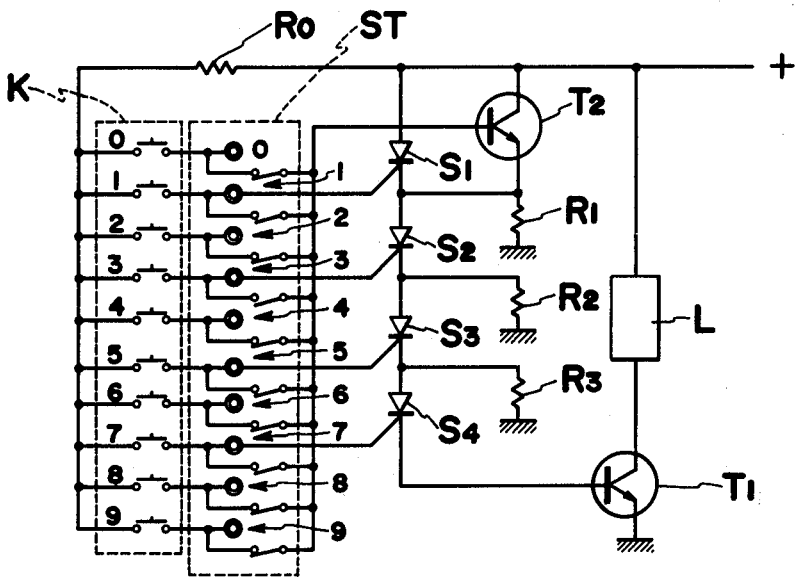
FIG. 2 is a circuit diagram showing one modified embodiment of the first circuit diagram.

FIG. 2 shows an embodiment which has been concretely modified from the foregoing embodiment. $T_1$, $T_2$ denote transistors, and the transistor $T_2$ corresponds to the open switch $K_x$, and is connected in parallel with the anode and cathode of the thyristor $S_1$. In this embodiment, 4 thyristors and 10 key type switches K are used. The number of the thyristors signifies the number of columns of code digits, and in this embodiment, the code digits have 4 columns. ST denotes a switch terminal which is the connection changeover mechanism, and is used for optionally changing the connection of the key type switches $K_0 \ldots K_9$ and transistor $T_2$ and the gates of thyristors $S_1 \ldots S_4$.

Figure 3:
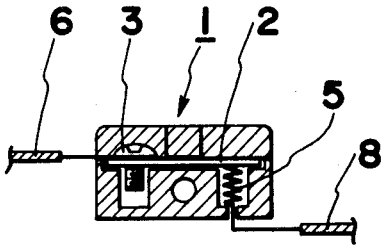
FIG. 3 is a vertical cross section showing a switch terminal which is an embodiment of a connection changeover mechanism, and showing the condition where thyristor gates are connected.
Figure 4:
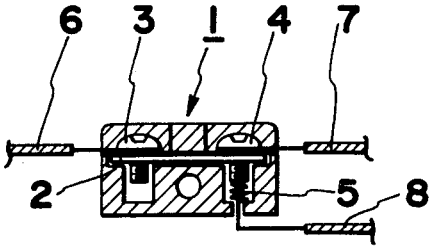
FIG. 4 is a vertical cross section showing similarly the condition where the thyristor gates are connected.

As shown in FIGS. 3 and 4, the switch terminal ST has a terminal 1 which is molded of insulating material, and in its hollow portion, a conductive plate which is a brass plate 2 pierced with two threaded holes is disposed. Reference numeral 3 denotes a screw, and is used to connect and fix a connection wire 6 from the key switch K to the brass plate 2. Reference numeral 4 denotes a screw molded of insulating material, and is used to connect and fix a connection wire 7 from the gate of the thyristor S to the brass plate 2. Reference numeral 5 denotes a spring contact made of conductive material, for example, copper and one terminal thereof is connected and fixed to a connection wire 8 from the base of the transistor $T_2$, and the other terminal abuts on the brass plate 2. When the connection wire 7 from the gate of the thyristor S is connected, spring contact 5 is disposed in the hollow portion of the terminal 1 so that it is pressed in a direction opposite to the brass plate 2 by means of the insulating screw 4 to be separated from the brass plate 2. The following manipulation may be made to connect the key type switches $K_0$ to $K_9$ and the gates of the thyristors $S_1$ to $S_4$ or the base of the transistor $T_2$ properly so that the transistor $T_1$ is energized only when the desired key type switches $K_0$ to $K_9$ are pressed by following the desired order with use of this switch terminal ST. For example, in case the code digits desired are 1357, the key type switches $K_0 \ldots K_9$ correspond to the digits of 0 . . . 9, the gates of the thyristors $S_1$, $S_2$, $S_3$ and $S_4$ of the switch terminals $ST_1$, $ST_3$, $ST_5$ and $ST_7$ are connected and only when the key type switches $K_1$, $K_3$, $K_5$, and $K_7$ are pressed in this order, is a connection provided so that the transistor $T_1$ is energized. When such a connection is made, in the switch terminals $ST_1$, $ST_3$, $ST_5$, and $ST_7$, the connection 8 of the transistor $T_2$ and the brass plate 2 become separated by means of the insulating screw 4, and therefore, the circuit connected to the base of the transistor $T_2$ becomes cut off. As long as the key type switches K are pressed in accordance with the code digits, the thyristors S which are self maintained sequentially from the power source side are not to be shifted into the non-self maintained state. On the other hand, in the remaining switch terminals $ST_0$, $ST_2$, $ST_4$, $ST_6$, $ST_8$, and $ST_9$, the circuit connected to the base of the transistor $T_2$ is in the connected state.

When one of the key type switches $K_0$, $K_2$, $K_4$, $K_6$, $K_8$, $K_9$ connected to the switch terminals ST is pressed, the transistor $T_2$ is energized. The current path between the anode and cathode of the thyristor $S_1$ is short-circuited and the thyristor $S_1$ is shifted from the self maintained state to the non-self maintained state immediately. As a result, the transistor $T_1$ cannot be energized and the load L is not operated.

In the present embodiment, more than two identical digits cannot be used as the code digits such as 1212, and 2323. However if the resistance value of the limiting resistor $R_0$ is changed or the structure of the switch terminal is changed, such code digits can be used. Also, in the present embodiment, the switch terminals are employed as the connection changeover mechanism, but instead of the switch terminals, converting preset switches, pinboards, on dial switches may be used which produce similar effects, and they may be selected properly according to the purpose of use.

As described in detail in the foregoing, the electronic locking device according to the present invention is composed of a proper number of key type switches and the connection changeover mechanism. For the power source, voltage number of thyristors multiplied by 0.8 V is sufficient, and even a dry cell battery can provide satisfactory operation. Accordingly, a compact and low cost electronic locking device can be obtained. Also, in the clear state, the collector breaking current of the transistor flows in some quantity, and besides, very little electric power is consumed which saves the electric energy. Furthermore, since the key type switches which are connected to the thyristors by the connection changeover mechanism can be simply changed, the code digits can be frequently changed optionally and the locking efficiency made extremely high.

Furthermore, if a buzzer or relay is connected in series to the transistor $T_2$ which releases the self maintaining state of the thyristors, it is possible to apply a completely fool-proof crime preventing monitor system utilizing such a system. In case the device according to the present invention is used as a double locking device in conjunction with a conventional lock with key, the crime prevention efficiency can be improved, and therefore the crime prevention efficiency of the present invention as an electronic locking device is extremely good.

What is claimed is:

1. An electronic combination controlled means comprising:

a plurality of thyristors connected in series, with the cathode of each of said thyristors connected to the anode of the next succeeding thyristor;

a plurality of self-holding resistors, each connected between a corresponding anode-cathode connection of said plurality of thyristors and ground and each having a resistance for conducting a current therethrough greater than the sustaining current of one of said thyristors;

a current limiting resistor having a resistance for conducting a current therethrough greater than the minimum gate turn-on current of one of said thyristors and less than twice said minimum gate turn-on current;

a current actuated means connected to the cathode of the last of said plurality of thyristors for being actuated when said last thyristor is turned on;

a thyristor turn-off means connected across the first of said thyristors for short circuiting the first of said thyristors when actuated thereby interrupting the current through and rendering nonconductive said first thyristor; and a plurality of key type switches including a first subset of key type switches equal in number to the number of said thyristors, each having a first terminal connected to said current limiting resistor and a second terminal connected to the gate of a corresponding one of said plurality of thyristors for turning on said corresponding thyristor when actuated and a second subset of key type switches connected to said thyristor turn-off means for actuating said thyristor turn-off means, whereby said current actuated means is actuated only when said first subset of key type switches are actuated in a predetermined order and none of said second subset of key type switches are actuated.

2. An electronic combination controlled means as claimed in claim 1 wherein:

said thyristor turn-off means comprises a thyristor turn-off transistor having a collector connected to the anode of said first thyristor, an emitter connected to the cathode of said first thyristor and a base connected to said second subset of key type switches for conducting current therethrough when one of said second subset of key type switches is actuated; and said electronic locking device further comprises a plurality of connection change over means equal in number to the number of said key type switches, each having a first terminal connected to a corresponding one of said plurality of key type switches and a second terminal selectively connectable to the gate of a corresponding thyristor or the base of said thyristor turn-off transistor, whereby said first subset of key type switches are connected to the gates of respective thyristors and said second subset of key type switches are connected to said thyristor turn-off means.

3. An electronic combination controlled means as claimed in claim 2 wherein said connection change over means comprises:

a base made of an electrically insulating material;

a conducting plate mounted in said base;

a connecting means connected to said conducting plate for connecting a corresponding one of said key type switches to said conducting plate;

an elastic contact means having an elastic portion normally forced against said conductive plate for providing electrical connection to said conductive plate and a connecting portion connected to said elastic portion for connecting said thyristor turn-off means to said conducting plate; and an insulating connecting means associated with said conducting plate and said elastic contact means for selectively connecting the gate of a corresponding one of said thyristors to said conducting plate and disconnecting said thyristor turn-off means from said conducting plate by forcing said elastic portion of said elastic contact means out of electrical contact with said conducting plate, whereby said corresponding key type switch is selectively connected to said thyristor turn-off means or the gate of said corresponding thyristor.

* * * * *